US005360022A

United States Patent [19]

Newton et al.

[11] Patent Number: 5,360,022

[45] Date of Patent: Nov. 1, 1994

[54] TOBACCO PROCESSING

[75] Inventors: Donald A. Newton, Winston-Salem, N.C.; Timothy R. Lang, Willoughby, Australia

[73] Assignee: R. J. Reynolds Tobacco Company, Winston-Salem, N.C.

[21] Appl. No.: 733,477

[22] Filed: Jul. 22, 1991

[51] Int. Cl.[5] ..... A24B 15/24

[52] U.S. Cl. ..... 131/297; 131/298

[58] Field of Search ..... 131/297, 298

[56] References Cited

U.S. PATENT DOCUMENTS

| | | |
|---|---|---|
| 1,156,609 | 10/1915 | Mewborne . |
| 2,805,667 | 9/1957 | Von Bethmann . |
| 3,575,178 | 4/1971 | Stewart . |
| 4,363,264 | 12/1982 | Lang et al. . |
| 4,448,208 | 5/1984 | Friedrich et al. . |
| 4,821,749 | 4/1989 | Toft et al. . |

OTHER PUBLICATIONS

*Food Engineering*, pp. 151–154 (May, 1986).

*Primary Examiner*—Jennifer Bahr

[57] ABSTRACT

Tobacco cut filler is subjected to extraction conditions using tap water as a solvent using a counter current, counter rotating, upwardly inclined extraction apparatus. The extracted tobacco material which is collected undergoes no significant physical degradation while having a high level of water extractables removed therefrom. Aqueous tobacco extracts having relatively high levels of tobacco extractables also can be provided. Extracted tobacco material also can be re-equilibrated with a tobacco extract by contacting the extracted tobacco material and an aqueous tobacco extract in a counter current, counter rotating, upwardly inclined extraction apparatus.

8 Claims, 2 Drawing Sheets

TOBACCO PROCESSING

BACKGROUND OF THE INVENTION

The present invention relates to tobacco, and in particular to a process for changing the character of a tobacco material.

Popular smoking articles, such as cigarettes, have a substantially cylindrical rod shaped structure and include a charge of smokable material, such as shreds or strands of tobacco material (i.e., in cut filler form), surrounded by a paper wrapper, thereby forming a tobacco rod. It has become desirable to manufacture a cigarette having a cylindrical filter element aligned in an end-to-end relationship with the tobacco rod. Typically, a filter element includes cellulose acetate tow circumscribed by plug wrap, and is attached to the tobacco rod using a circumscribing tipping material.

Tobacco undergoes various processing steps prior to the time that it is used for cigarette manufacture. Oftentimes, tobacco is chemically or physically treated to modify its flavor and smoking characteristics. In certain circumstances, it may be desirable to selectively remove components, such as nicotine, from tobacco. Various processes directed toward removing nicotine from tobacco have been proposed. Many of such types of processes are discussed in European Patent Application No. 280817 and U.S. Pat. No. 4,744,375 to Denier, et al. Another process for removing nicotine from tobacco is described in European Patent Application No. 323699. Processes for altering the character of tobacco materials (e.g., tobacco cut filler) are proposed in U.S. Pat. No. 5,025,812 to Fagg, et al. and U.S. patent application Ser. No. 484,587, filed Feb. 23, 1990, which are incorporated herein by reference.

It would be desirable to provide a process for efficiently and effectively altering the chemical nature or composition of tobacco, and in particular to provide a process for removing selected components from a tobacco material and/or adding selected substances to a tobacco material. It also would be desired to provide processes for extracting a tobacco material using a liquid extraction solvent so as to provide (i) an extracted tobacco material having a relatively high level of extractables removed therefrom, and (ii) a tobacco extract within solvent at a relatively high level of dissolved tobacco solids.

SUMMARY OF THE INVENTION

The present invention relates to a process for changing the character of a tobacco material. In particular, the process involves extracting or otherwise removing certain components of a tobacco material from that material using a suitable extraction solvent (e.g., a liquid having an aqueous character). In one preferred embodiment, the process involves extracting certain components of a tobacco material (e.g., extractables) using a liquid extraction solvent so as to provide a relatively high concentration of tobacco extractables within the solvent. In another preferred embodiment, the process involves extracting an extremely high level of tobacco extractables from the tobacco material. In yet another preferred embodiment, the process involves extracting certain components of a tobacco material to provide a tobacco extract and an extracted tobacco material and then redistributing certain extract components within the extracted tobacco material (or a mixture of extracted tobacco material and tobacco material which has not previously been subjected to extraction conditions), preferably without changing many of the physical characteristics of the extracted tobacco material to a significant degree. In certain embodiments, the process involves altering the chemical nature of a tobacco material (e.g., by removing at least one selected component from a tobacco material and/or by adding at least one selected substance to that tobacco material).

In one aspect, the process of the present invention involves providing extracted tobacco material by extracting tobacco material using a liquid extraction solvent using a counter current, counter rotating extraction apparatus which is positioned at an upward incline relative to horizontal. An exemplary apparatus is set forth in U.S. Pat. No. 4,363,264 to Lang, et al., and *Food Engineering*, pp. 151–154 (May, 1986); which are incorporated herein by reference. The extracted tobacco material is the portion of the tobacco material insoluble in the solvent, and that material is separated from the solvent and tobacco extract extracted by the solvent. The solvent can have a relatively high level of tobacco extractables therein, in certain circumstances. In other circumstances, the solvent can remove a relatively high level of extractables from the tobacco material. In a preferred aspect, the tobacco material undergoes minimal physical degradation during extraction conditions which provide an extracted tobacco material from that tobacco material.

The process also can involve further steps. A tobacco extract can be provided by extracting tobacco material using a liquid extraction solvent. The chemical composition of the tobacco extract then most desirably is altered so as to provide a processed tobacco extract. In a highly preferred embodiment, the processed tobacco extract is provided by removing at least one selected tobacco component from the extract and/or by adding at least one selected substance to the extract. The tobacco extract, extraction solvent and extracted tobacco material (or a mixture of extracted tobacco material and tobacco material which has not previously been subjected to extraction conditions) are contacted with one another. Normally, the tobacco extract is provided within extraction solvent, and the extract and solvent are contacted with the extracted tobacco material using a counter rotating extraction apparatus. As such, an extracted tobacco material is re-equilibrated with tobacco extract under infusion conditions such that the extract and extracted tobacco material are in intimate contact. In a preferred aspect, the extraction apparatus is a counter current extraction apparatus which is positioned at an upward angle relative to horizontal. An exemplary apparatus is of the type set forth in U.S. Pat. No. 4,363,264 to Lang, et al., and *Food Engineering*, pp. 151–154 (May, 1986). As such, there is provided a resulting mixture of (i) solvent, (ii) tobacco extract, and (iii) extracted tobacco material. The extracted tobacco material is separated from a predetermined portion of the tobacco extract and solvent. At least a portion of the solvent then is separated from the resulting mixture to provide a processed tobacco material.

The process of the present invention provides the skilled artisan with an efficient and effective method for changing the character of a tobacco material (e.g., rearranging components of a tobacco material or altering the chemical nature or composition of a tobacco material) in a controlled manner. That is, the process of the present invention can be employed in a way such that changes in the chemical composition of tobacco can be monitored so as to occur to a desired degree. Preferably, the process involves (i) removing selected substance(s) from a tobacco material, (ii) incorporating controlled amounts of selected substance(s) into a tobacco material, (iii) both removing selected substances from a tobacco material and incorporating selected substances into that tobacco material, or (iv) removing and redistributing tobacco components of a tobacco material in a controlled manner. In particular, significant quantities of selected substance(s), such as nicotine, can be removed from a tobacco material while the removal of other substances from that tobacco material is minimized. A particular process according to the present invention involves denicotinizing tobacco material (e.g., in cut filler or strip form) such that greater than about 90 percent, and frequently greater than about 95 percent, of the nicotine present within the starting tobacco material is removed therefrom. Also of interest is a process whereby a tobacco extract and an extracted tobacco material can be processed separately, and then the processed tobacco extract and processed extracted tobacco material can be contacted with one another to provide a processed tobacco material. Also of interest are those processes which provide tobacco materials having high levels of extractables removed therefrom; and which provide a very high degree of extraction of a tobacco material.

DETAILED DESCRIPTION OF THE PREFERRED EMBODIMENTS

Figure 1:
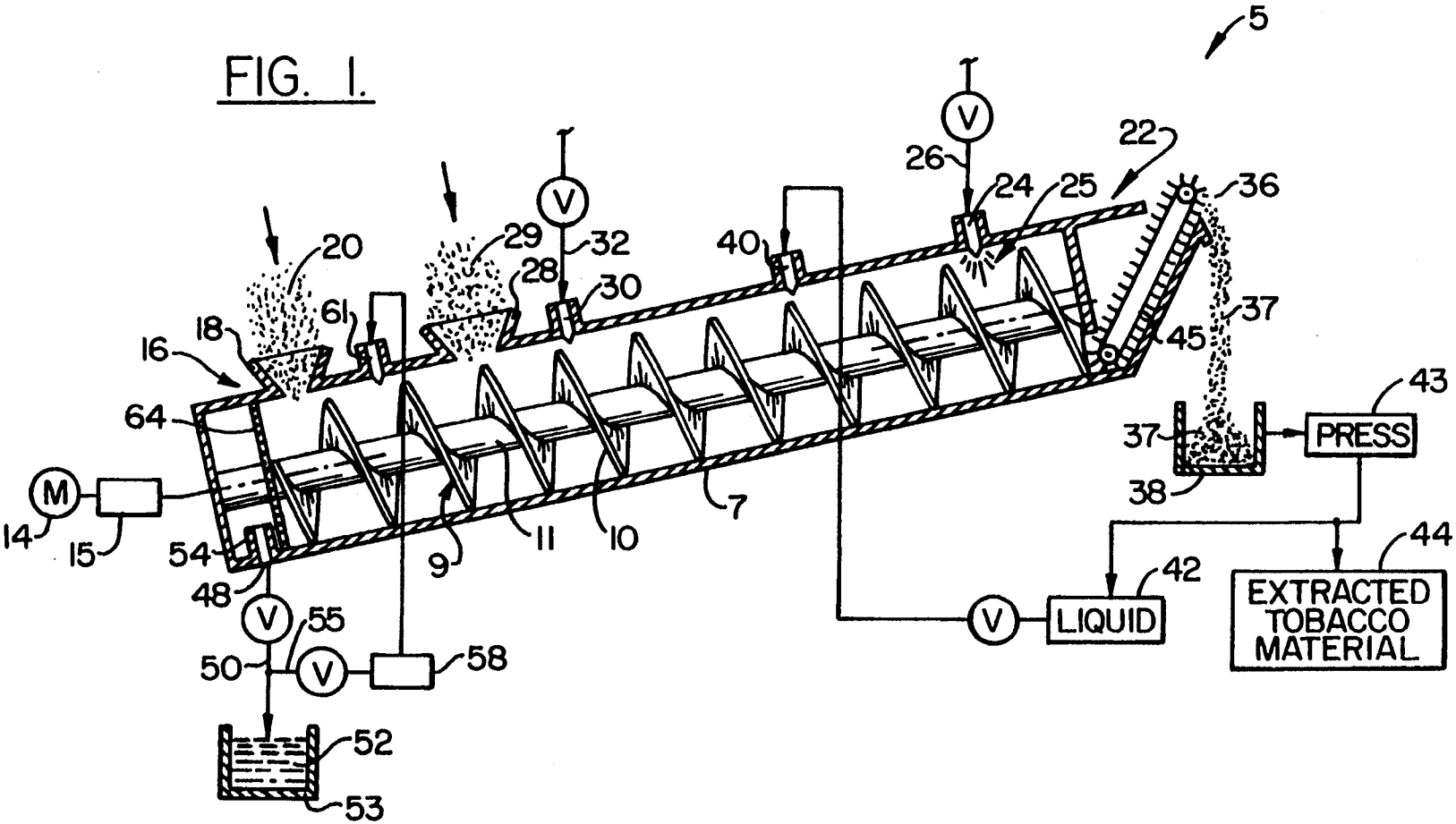
FIG. 1 is a schematic diagram of an apparatus useful in the process of the present invention.

Referring to FIG. 1, a counter current extraction apparatus 5 includes an elongated trough or tube shaped housing 7. The housing can be provided with a hot/cold water jacket (not shown) if desired. Typically, the housing is open to atmospheric pressure conditions and the apparatus is employed under conditions of essentially ambient pressure. A screw conveyor 9 is positioned in the housing 7. The screw conveyor includes helical flight 10 disposed about spindle 11; and the helical flight can include circumferentially directed slits (not shown) as well as radially extending ribs (not shown). The conveyor is arranged to be rotated about its longitudinal axis by a motor 14 (e.g., a 5 to 10 horsepower electric motor), or other suitable drive means. A gearbox 15 is provided between the drive means and the screw conveyor to intermittently reverse the direction of rotation of the screw conveyor. For example, the motor can be reversed by a reversing starter which drives the screw conveyor through a gearbox, such as a Eurodrive Model KA-156--R92; or the motor can drive a reversing electrohydraulic speed control, such as is furnished by VAR-SPE spa, Tavernelle, Italy. As such, the screw conveyor can be operated in a counter rotating manner. The housing 7, at one end 16 (i.e., upstream end), is provided with an inlet hopper 18 for introducing tobacco material 20 (e.g., tobacco stems, cut filler or strip) into the apparatus 5 in order that the tobacco material can be extracted. The housing 7, at the other end 22 (i.e., downstream end), is provided with a spray nozzle 24, or other means for introducing extraction solvent 25 from a feed line 26 from a source (not shown). If desired, a second hopper 28 can be positioned downstream from inlet hopper 18 in order that a further amount of tobacco material 29 (e.g., tobacco dust) optionally can be introduced into the housing 7. If desired, a second nozzle 30 can be positioned downstream from the second hopper 28, in order that a further amount of extraction solvent or a reactant material (e.g., an enzyme mixture, or an aqueous solution of acetic acid or ammonium hydroxide) from feed line 32 from a source (not shown) can be introduced into the housing 7. As such, the solvent and tobacco material contact each other in a counter current manner.

The housing 7 is positioned on an incline such that the tobacco material is introduced into the lower region thereof, and the extraction solvent is introduced into the upper region thereof. The incline can vary, but typically is greater than about 2°, typically is less than about 20°, and normally is less than about 15°; and usually ranges from about 3° to about 10°, preferably about 4° to about 8°, relative to horizontal. The incline is an upward incline in order that the tobacco material 20 introduced into the apparatus overall generally upwards as it is moved along by the screw conveyor through the housing 7. Similarly, solvent introduced into the apparatus travels overall downwards as it travels through the housing 7.

The apparatus also includes an outlet spout 36, downstream from nozzle 24, in order that a mixture 37 of extracted tobacco material, solvent and tobacco extract can exit (i.e., be removed from) the apparatus and be collected in container 38, or other suitable collection means (e.g., onto a conveyor belt for transport to a desired location). If desired, a third nozzle 40 can be positioned downstream from the optional second nozzle 30 in order that liquid 42 separated (e.g., by pressing 43), from the mixture 37 including extracted tobacco material can be introduced into the housing 7. Pressing 43 of the mixture 37 results in (i) liquid 42 in the form of a weak aqueous tobacco extract, and (ii) extracted tobacco material 44. As shown in FIG. 1, the tobacco material can be removed from the housing using a conveyor belt 45 which carries the extracted tobacco material upwards out of the apparatus through outlet spout 36. Alternatively, the outlet spout can be positioned on the underside or end of the housing 7.

A liquid discharge port 48 connected to discharge line 50 allows extraction solvent and tobacco extract contained therein 52 to exit (i.e., be removed from) the apparatus and be collected in container 53, such as a liquid collection tank. If desired, an adjustable height overflow pipe 54 can be positioned in the trough above the discharge port 48 in order that a pool of liquid (not shown) of the desired depth can form in the extreme upstream end of the trough (and hence, a controlled amount of liquid is maintained in the trough). A by-pass line 55 from discharge line 50 can allow for a certain amount of extraction solvent and tobacco extract contained therein to pass through heat exchange unit 58 (e.g., a counterflow tubular heat exchanger); and returned to the housing of the apparatus through feed nozzle 61, which is positioned downstream from inlet hopper 18. A screen 64 is positioned at the extreme upstream end of the helical flight 10 and upstream from the hopper 18, in order to allow solvent and extract to exit the housing 7 through discharge port 48, while preventing extracted tobacco material from exiting the housing through the discharge port.

The apparatus 5 can be used to extract tobacco material. During extraction, tobacco material 20 is introduced continuously into housing 7 through inlet hopper 18, and the screw conveyor 7 is rotated to facilitate movement of the tobacco material downstream through the housing. Extraction solvent 25 is introduced continuously into the housing through nozzle 24 from feed line 26. As such, the tobacco material and solvent are continuously introduced into the apparatus and are contacted under extraction conditions in a counter current manner. The solvent contacts the tobacco material, and the tobacco material is subjected to extraction conditions under atmospheric pressure essentially equal to ambient pressure. As such, components of the tobacco material which are soluble or dispersible in the solvent transfer to the solvent. The direction of rotation of the screw conveyor then is reversed. Then, the direction of the screw conveyor is reversed to its original direction so that the tobacco material continues to be carried downstream. As such, the screw conveyor operates in a counter rotating manner as the tobacco material is subjected to extraction conditions. Extracted tobacco material 37 exits the housing through outlet spout 36, and tobacco extract contained within extraction solvent 52 exits the housing through discharge port 48. The extract within solvent passes through discharge line 50, and is collected in container 53, such as a liquid collection tank. If desired, a portion of the extract and solvent can be diverted into by-pass line 55, heated in heat exchange unit 58, and returned to the housing through feed nozzle 61 positioned upstream from hopper 18.

The apparatus 5 can be used to re-equilibrate an extracted tobacco material with tobacco extract. During re-equilibration, extracted tobacco material (e.g., tobacco material that has been extracted using an extraction solvent and has had tobacco extract separated therefrom), or a mixture of extracted tobacco material and a tobacco material which previously has not been subjected to extraction conditions, is introduced continuously into housing 7 through inlet hopper 18, and the screw conveyor 10, 11 is rotated in a counter rotating manner so as to carry that material downstream through the housing. Tobacco extract in liquid form (e.g., tobacco extract contained within extraction solvent therefor) is introduced continuously into the housing preferably through nozzle 24 from feed line 26. The tobacco extract contacts the extracted tobacco material in the housing, normally in a countercurrent manner. Extracted tobacco material in intimate contact with tobacco extract and solvent exits the housing through outlet spout 36 and is collected, and tobacco extract contained within solvent exits the housing through discharge port 48 and is collected. As such, tobacco extract is redistributed or infused in the extracted tobacco material.

Prior to commencing re-equilibration of the extracted tobacco material with liquid tobacco extract, it is desirable to establish a pool of dilute liquid tobacco extract in the housing of the apparatus in the region where extracted tobacco material is introduced into the housing. Typically, dilute liquid extracts comprise about 85 to about 95 weight percent solvent. After initial extracted tobacco material is introduced into the housing and contacts the dilute liquid extract, a less dilute liquid extract can be introduced into the housing. Typically, less dilute liquid extracts comprise about 75 to about 85 weight percent solvent. Then, the liquid tobacco extract at its desired re-equilibration concentration (e.g., about 65 to about 75 weight percent solvent) is introduced into the housing, and the continuous re-equilibration of continuously supplied extracted tobacco material with the solvent and extract is carried out. Contacting extracted tobacco material with progressively more concentrated liquid extracts minimizes or eliminates the affects of "osmotic shock" which negatively affects the infusion of extract into the extracted tobacco material.

Figure 2:
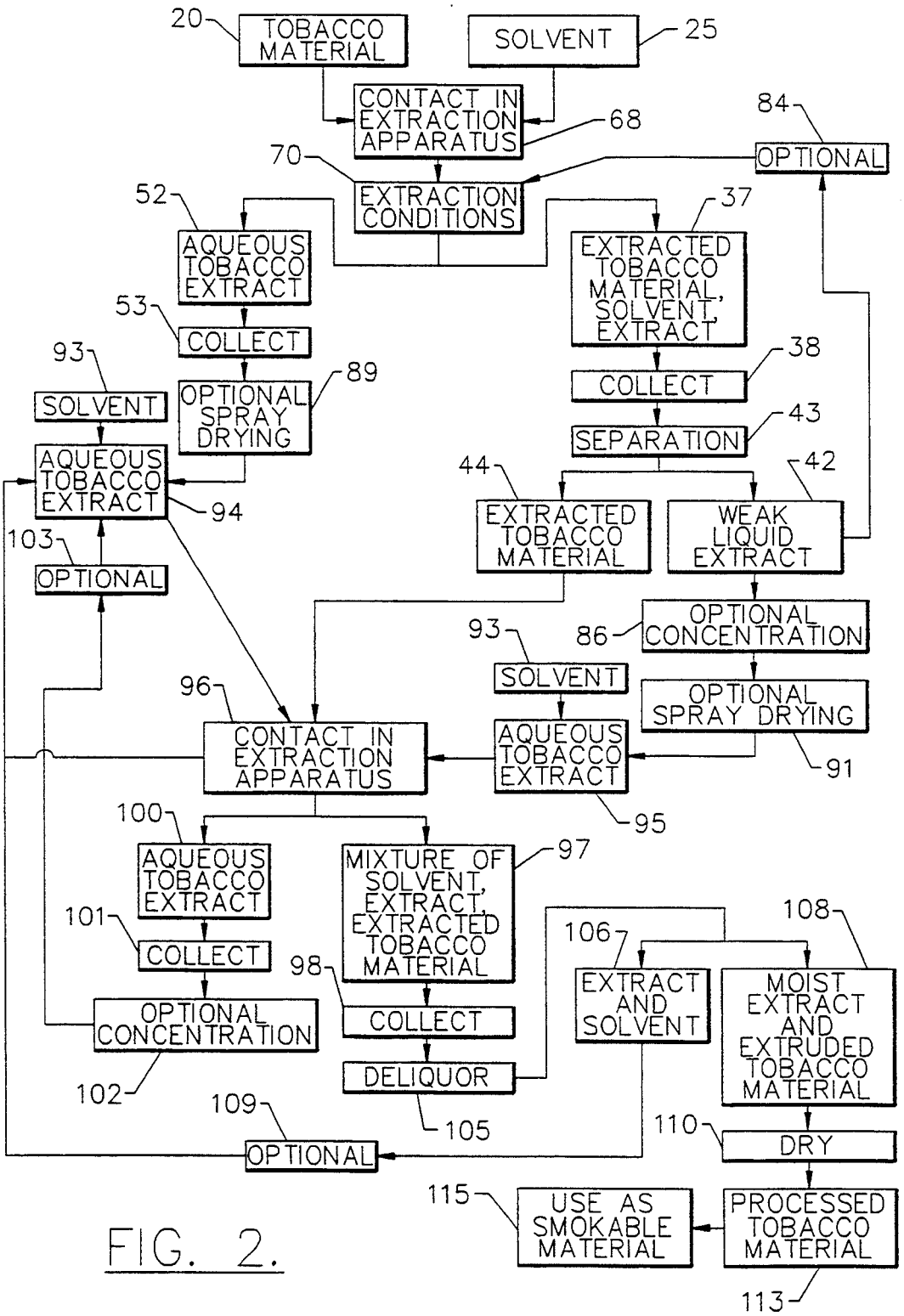
FIG. 2 is a schematic diagram of the process steps representative of an embodiment of the present invention.

Referring to FIG. 2, tobacco material 20, such as tobacco stem, cut filler or strip, is contacted 68 with an aqueous extraction solvent 25. Contact is performed in a continuous manner using a counter current extraction apparatus of the type previously described with reference to FIG. 1. Exemplary apparatus are available as CCE Model Nos. 500, 1000 and 1200 from Counter Current Technology Pty., Ltd. The tobacco material is subjected to extraction conditions 70. Aqueous tobacco extract 52 (i.e., a water soluble tobacco extract within the extraction solvent) exits the extraction apparatus through the liquid discharge port and is collected 53. A mixture 37 of extracted tobacco material, solvent and tobacco extract also exits the apparatus and is collected 38. The mixture 37 is subjected to separation conditions 43 (e.g., using a press or centrifuge) so as to provide, (i) a weak aqueous tobacco extract 42, and (ii) a damp extracted tobacco material 44 (i.e., a water insoluble tobacco residue). Normally, the collected aqueous tobacco extract 42 is disposed of. However, if desired, the collected aqueous tobacco extract 42 optionally can be combined 84 with the solvent and tobacco material in the extraction apparatus. Optionally, the aqueous tobacco extract 53 is concentrated 86 to an appropriate dissolved tobacco solids level using a thin film evaporator, or the like. Furthermore, the aqueous tobacco extracts 53, 86 optionally can be spray dried 89, 91 or otherwise processed for handling reasons, and later redissolved in water.

Aqueous extract, which can be spray dried tobacco extract 89, 91 obtained from aqueous extract 53, 86 is combined with aqueous solvent 93 to provide an aqueous tobacco extract 94, 95 having a predetermined solvent and extract content. The aqueous tobacco extract 94, and optionally aqueous tobacco extract 95, then is contacted 96 with extracted tobacco material 44 using an extraction apparatus of the type previously described with reference to FIG. 1. Exemplary apparatus are available as CCE Model Nos. 500, 1000 and 1200 from Counter Current Technology Pty, Ltd. Contact of the resulting mixture of extract, extracted tobacco material and solvent is effected until the extract has had sufficient contact time with the extracted tobacco material to allow infusion of the extract into the extracted tobacco material. Then, a mixture 97 of solvent, extract and extracted tobacco material is removed from the extraction apparatus and collected 98, separately from aqueous tobacco extract 100 which is also collected 101. If desired, the aqueous tobacco extract 100 can be concentrated 102 to a desired concentration and combined 103 with aqueous tobacco extract 94 for further use.

After collection of the mixture 98 of tobacco material, extract and solvent is complete, the mixture is deliquored 105. For example, the mixture is squeezed or pressed to remove a certain portion 106 of the extract and solvent (i.e., aqueous extract) therefrom. The resulting moist mixture of extract and water insoluble tobacco material 108 is such that the water insoluble tobacco material has a predetermined amount of extract in contact therewith. The extract and solvent 106 collected after pressing the mixture 98 optionally can be (i) combined 109 with the aqueous tobacco extract 94 or (ii) directly fed back into the extraction apparatus 96.

The deliquored tobacco material 108 is subjected to a drying operation 110 so as to yield a processed tobacco material 113 having a moisture content of about 10 to about 15 weight percent. The processed tobacco material includes tobacco extract in intimate contact with the extracted tobacco material. The resulting processed tobacco material 113 is used as smokable material 115 for the manufacture of cigarettes. For example, the processed tobacco material can be cased, top dressed, further processed or treated (e.g., volume expanded), screened to provide material of the desired size, and/or blended with other smokable materials.

The tobacco material which is processed according to the process of the present invention can vary. The tobacco materials which are used are of a form such that, under extraction conditions, a portion thereof is soluble in (i.e., extracted by) the extraction solvent and a portion thereof is insoluble in (i.e., not extracted by) the extraction solvent. Examples of types of suitable tobacco materials include flue-cured, Burley, Md. and Oriental tobaccos, as well as the rare or specialty tobaccos. Normally, the tobacco material has been aged. The tobacco material can be in the form of laminae and/or stem, or can be in a processed form. For example, the tobacco material can be in the form of whole leaf, strip, cut filler, processed stem, volume expanded tobacco filler, reconstituted strip or cut filler, or tobacco previously extracted to a certain degree. Tobacco waste materials and processing by-products (e.g., scrap and dust) also can be employed, particularly in combination with pieces of tobacco stem. The aforementioned tobacco materials can be processed separately, or as blends thereof.

The tobacco material can have a variety of sizes for extraction. The tobacco material most preferably is in strip form or cut filler form. Tobacco materials in strip or cut filler form are desirable in that the ultimately processed tobacco materials are employed as such for the manufacture of cigarettes. Tobacco scrap, stems and dust, as well as previously processed tobacco material, also can be extracted according to the process of the present invention to provide an extract, and the resulting extracted tobacco material can be formed into a predetermined (e.g., sheet-like) shape, thus providing a reconstituted tobacco material.

The tobacco material is contacted with an extraction solvent. A highly preferred extraction solvent is a solvent having an aqueous character. Such a solvent consists primarily of water, is normally greater than 90 weight percent water, and can be essentially pure water in certain circumstances. Essentially pure water can include deionized water, distilled water or tap water. The extraction solvent can be a co-solvent mixture, such as a mixture of water and minor amounts of one or more solvents which are miscible therewith. An example of such a co-solvent mixture is a solvent consisting of 95 weight parts water and 5 weight parts ethanol. The extraction solvent also can include water having substances such as pH adjusters (i.e., acids or bases) or pH buffers dissolved therein. For example, an aqueous solvent can have ammonium hydroxide or gaseous ammonia incorporated therein so as to provide a solvent having a pH of about 8 or more. Extraction solvent including an enzyme mix also can be employed. See, U.S. patent application Ser. No. 721,860, filed Jun. 21, 1991, which is incorporated herein by reference.

The amount of tobacco material which is contacted with the extraction solvent can vary. The amount of solvent relative to tobacco material depends upon factors such as the type of solvent, the temperature at which the extraction is performed, the type or form of tobacco material which is extracted, the manner in which contact of the tobacco material and solvent is conducted, the type of extraction process which is performed, and other such factors.

Tobacco material is extracted continuously using a solvent. Normally, the weight of solvent relative to that of the tobacco material with which is introduced into the extraction apparatus during the continuous extraction process is about 3:1 to about 12:1, usually about 4:1 to about 9:1. Normally, a greater amount of solvent results in relatively high extraction efficiencies of the tobacco material while a lower amount of solvent results in fairly concentrated liquid extracts.

The tobacco material can have various forms during extraction. Typically, tobacco material pieces of very large size experience poor extract efficiency. However, tobacco material particles of very small size can form deposits on the screw flight, and hence the extraction solvent can exhibit a tendency to flow around packed tobacco material, resulting in poor extraction efficiency. Preferably, the size and character of the tobacco material are such that the tobacco material (i) is not lifted out of extraction solvent by the counter rotating screw flight during extraction conditions, (ii) experiences even contact with the solvent, and (iii) allows for good, not overly restricted flow of solvent through the housing so as to allow good contact with the tobacco material during extraction conditions.

The screw conveyor is rotated forward during extraction conditions so as to move the tobacco material downstream through the housing. The forward speed of rotation of the screw conveyor can vary, but typically ranges from about 1 rpm to about 5 rpm, and usually from about 1 rpm to about 3 rpm. The screw conveyor also is counter rotated during extraction conditions. As such, the screw conveyor also is rotated in reverse (e.g., at a speed of about 1 to about 5 rpm) during extraction conditions. Oftentimes, a pause period can be provided at the time that the screw conveyor is shifted from forward rotation to reverse rotation and/or at the time that the screw conveyor is shifted from reverse rotation to forward rotation. The speed of the forward rotation relative to the speed of reverse rotation of the screw conveyor, the length of time that the screw conveyor rotates forward and in reverse, and the length of the optional pause period can vary and can be determined by experimentation. The selection of forward and reverse rotation speeds and forward and reverse rotation times are such that the tobacco material moves overall downstream through the housing during extraction conditions. The selection of forward and reverse rotation speeds and forward and reverse rotation times are such that the tobacco material is well contacted (e.g., well mixed) with the solvent so as to allow a relatively great amount of surface contact of the tobacco material with the solvent.

The residence time of the tobacco material in the extraction apparatus during extraction conditions can vary. For example, for a continuous counter current extractor available as CCE Model No. 1000 from Counter Current Technology Pty. Ltd., a screw conveyor having a helical flight and operated at a forward speed of about 1.88 rpm for about 20 seconds, at a reverse speed of about 1.88 rpm for about 16.3 seconds, and with a pause time of about 2.5 seconds each time the direction of rotation of the screw conveyor changed results in an average residence time of the tobacco material in the extractor of about 59 minutes. Alternatively, the screw conveyor of the CCE Model No. 1000 can be operated at a forward speed of about 2.5 rpm for about 15 seconds, at a reverse speed of about 1.25 rpm for about 20.4 seconds, and essentially no pause time each time the direction of rotation of the screw conveyor is changed results in an average residence time of the tobacco material in the extractor of about 59 minutes. As another example, the screw conveyor of the CCE Model No. 1000 can be operated at a forward speed of about 1.88 rpm for about 20 seconds, a reverse speed of about 1.88 rpm for about 14.8 seconds, and with a pause time of about 2.5 seconds each time the direction of rotation of the screw conveyor is changed results in an average residence time of the tobacco material in the extractor of about 40 minutes.

The flight of the screw conveyor can include optional attachments on the upstream surface or downstream surface thereof. Such attachments can assist in lifting and agitating the tobacco material within the extraction apparatus during extraction conditions. For example, lifter bars (e.g., about 2 inch high) can extend from the downstream side of the flight along the length of the helical flight. Other attachments include pins protruding (e.g., to about 2 inches) from each side of the flight along the length of the flight; equilateral triangle-shaped pieces protruding from the face of the flight and positioned along the length of the flight; ramp-like attachments for lifting tobacco material during forward rotation of the screw conveyor; and rods (e.g., 0.5 inch diameter metal rods) bolted between adjacent flights near the outer edge of the screw flight adjacent the housing or trough wall.

Typically, adequate extraction of components from the tobacco material occurs in less than about 90 minutes, oftentimes in less than about 60 minutes, and sometimes less than about 30 minutes. Normally, the average residence time of the tobacco material in the extractor is about 45 to about 60 minutes. The tobacco material can be subjected to extraction conditions two or more times by passing the tobacco material through the extraction apparatus more than one time (e.g., using different solvents and/or different extraction conditions each time). Alternatively, the tobacco material can experience a variety of extraction conditions. For example, reactant materials can be introduced into the extraction apparatus, usually downstream from the region where the tobacco material is introduced into the apparatus.

The conditions under which the extraction is performed can vary. Conditions of temperature can be less than, greater than, or about equal to, ambient temperature. Typical temperatures range from about 2° C. to about 90° C., often about 10° C. to about 80° C., and frequently about 50° C. to about 70° C.

A wide variety of components can be extracted from the tobacco materials. The particular components and the amounts of the particular components which are extracted often depend upon the type of tobacco which is processed, the properties of the particular solvent, and the extraction conditions (e.g., which include the temperature at which the extraction occurs as well as the time period over which an extraction is carried out). For example, an extraction solvent consisting essentially of pure water will most often extract primarily the water soluble components of the tobacco material, while a co-solvent mixture of water and a minor amount of an alcohol can extract the water soluble components of the tobacco material as well as certain amounts of tobacco substances having other solubility characteristics. Water soluble tobacco components which are extracted from a tobacco material using a solvent having an aqueous character include alkaloids, acids, salts, sugars, and the like. Water soluble extracted tobacco components include many of the flavorful substances of the tobacco material.

The extraction solvent and tobacco extract then are separated from the insoluble tobacco residue. Although a significant amount of extraction solvent and tobacco extract is separated from the insoluble tobacco residue (i.e., extracted tobacco material) using the countercurrent, counter rotating, upwardly inclined extraction apparatus, the tobacco material exiting the extraction apparatus can be subjected to further separation techniques. The manner of separation can vary; however, it is convenient to employ conventional separation techniques involving the use of filters, centrifuges, screw presses, converging belts, rotating disk presses, and the like. Preferably, the insoluble residue is treated so as to remove a predetermined amount of solvent and tobacco extract therefrom.

The solvent and tobacco components extracted thereby can be filtered to remove suspended insoluble particles; concentrated; diluted with solvent; or spray dried, freeze dried, or otherwise processed, particularly for storage or handling reasons. Dried extracts, such as spray dried tobacco extracts, can be later redissolved in extraction solvent for later treatment and further extraction process steps.

The characteristics of the tobacco extract and the extracted tobacco material can vary, depending upon the types of extraction conditions which are employed. In certain instances, a relatively high level of extractables can be removed from (e.g., extracted from) the tobacco material. For example, for a liquid having an aqueous character, greater than about 80 weight percent, often greater than about 85 weight percent and frequently greater than about 90 weight percent, of the hot water solubles can be removed from the tobacco material. Hot water solubles are determined by extracting about 2 g of finely ground tobacco material with about 2 1. of water at 70° C., and comparing the initial weight of the tobacco material to that weight of the extracted tobacco material using an AVC-80 from CEM Corp.

In certain instances, the liquid extraction solvent is employed in an efficient manner so as to provide a tobacco extract within the extraction solvent such that there is a relatively high concentration of tobacco extractables within the solvent. High concentrations of tobacco extractables within solvent typically are above about 20 weight percent, often above about 25 percent, and sometimes above about 30 percent, based on the weight of solvent and extractables therewithin.

The chemical composition of the tobacco extract can be altered if desired so as to provide a processed extract, and a variety of techniques can be employed to alter the chemical composition of the tobacco extract. For example, the tobacco extract can be heat treated; processed to remove nicotine, nitrates or other such components therefrom; provided within solvent and subjected to membrane treatment to remove certain soluble or dispersible components (e.g., as set forth in U.S. Pat. No. 4,941,484 to Clapp, et al.; or contacted with at least one additive including casing materials (e.g., glycerin or propylene glycol), top dressing materials, organic acids (e.g., citric, ascorbic, malic, tartaric, lactic, acetic, levulinic, succinic or malonic acids), monoammonium phosphate, diammonium phosphate, ammonia, sugars (e.g., sucrose, dextrose, glucose or fructose), amino acids, hydrolyzed amino acids, metal ions (e.g., types and amounts sufficient to alter the combustion properties of the ultimate processed tobacco material), or combinations thereof. Materials such as menthol can be contacted with the extract, if desired. See, U.S. patent application Ser. No. 720,308, filed Jun. 25, 1991, which is incorporated herein by reference. The types and amounts of additives which are incorporated into a particular tobacco extract can vary, depending upon the desired nature of the ultimate tobacco material which is processed, and the types and amounts of additives employed can be determined by experimentation. If desired, certain components can be removed from the tobacco extract and certain selected additives can be incorporated into the tobacco extract. If desired, a tobacco extract within extraction solvent can be subjected to enzyme, ion exchange, absorption, electrodialysis or further extraction treatments. In a preferred aspect, an aqueous tobacco extract is subjected (i) to liquid/liquid extraction processing steps as described in U.S. Pat. No. 4,967,771 to Fagg, et al. and U.S. patent application Ser. No. 484,587, filed Feb. 23, 1990, (ii) to supercritical extraction processing steps, as described in European Patent Application No. 338,831, which is incorporated herein by reference, or (iii) to further treatment as set forth in European Patent Application No. 326,370, which is incorporated herein by reference. Methods for removing nitrates from tobacco extracts (e.g., for removing potassium nitrate from a Burley extract) will be apparent to the skilled artisan. See, U.S. Pat. No. 4,131,117 to Kite, et al.

The tobacco extract, which can be a processed tobacco extract, is provided within extraction solvent. As such, a further amount of extraction solvent can be added to the processed tobacco extract, or the processed tobacco extract within extraction solvent can be concentrated. Normally, a predetermined amount of processed tobacco extract (i.e., dissolved tobacco solids) is provided within extraction solvent. The predetermined amount of tobacco extract is such that, when the contact of extracted tobacco material with the tobacco extract and solvent is complete, and a portion of the solvent and tobacco extract is separated therefrom, a predetermined portion of the solvent and tobacco extract remains in contact with the insoluble tobacco portion of the extracted tobacco material.

A processed extract within extraction solvent (e.g., an aqueous tobacco extract) normally is provided such that the dissolved tobacco solids within the ultimate mixture of extract, solvent and (tobacco material insoluble in the solvent) is between about 5 and about 40 percent, preferably between about 8 and about 34 percent, more preferably between about 10 and about 30 percent, most preferably between about 15 and about 25 percent, based on the total weight of the tobacco extractables and solvent. Such an aqueous extract can be contacted with extracted tobacco material, and the insoluble portion of the tobacco material can be deliquored to provide a moist mixture of insoluble extracted tobacco material and tobacco extract having a moisture content of about 60 to about 90 weight percent, preferably about 65 to about 85 weight percent. The ultimate amount of tobacco extract in intimate contact with the extracted tobacco material can vary, depending upon the concentration of extract within the solvent and the level to which the resulting mixture is deliquored.

An extracted tobacco material is provided. Normally, the tobacco material which is extracted using extraction solvent to provide the extracted tobacco material has a form such as cut filler or strip, in order that the extracted tobacco material which is provided can be further processed according to the present invention and can be employed as such for cigarette manufacture. Manners and methods for extracting tobacco materials are set forth herein before. The tobacco material which is extracted can be one type of tobacco material or a blend of various types of tobacco materials. The extracted tobacco material is the tobacco residue which is not soluble in (i.e., not extracted by) the extraction solvent. Preferably, the tobacco material is subjected to extraction conditions in the presence of sufficient extraction solvent and under conditions sufficient to provide an extracted tobacco material having a high level of the tobacco extractables removed from the tobacco material. The extracted tobacco material is separated from the solvent and tobacco extract to provide an extracted tobacco material having a low level of tobacco extractables. The extracted tobacco material then can be employed in further processing steps of the present invention, or the extracted tobacco material can have a certain amount of the solvent removed therefrom (e.g., the extracted material can be dried, when the solvent has an aqueous character) prior to being employed in further processing steps of the present invention.

If desired, the physical and/or chemical composition of the extracted tobacco material can be altered. The extracted tobacco material can be reformed, cut to a desired size or shape, or otherwise physically altered, particularly when the extracted tobacco material is in a fairly moist form. The extracted tobacco material can be heat treated or otherwise processed to change the chemical composition of that material. In particular, the extracted tobacco material can be subjected to enzyme treatment as set forth in U.S. Pat. No. 4,887,618 to Bernasek, et al., reacted with certain agents or further extracted (e.g., an extracted tobacco material provided from an extraction of a tobacco material with an aqueous solvent can be subjected to extraction conditions using a hydrophobic solvent, such as hexane). If desired, the extracted tobacco material can be combined with fillers, such as cellulosic fillers (e.g., flax and/or wood pulp fibers). The extracted tobacco material can be combined with a tobacco material which previously has not been subjected to extraction conditions (e.g., aqueously extracted pieces of Burley tobacco stems can be combined with tobacco cut filler in unextracted form). The extracted tobacco material can be formed into a sheet-like shape (e.g., using papermaking techniques) and then have liquid tobacco extract applied thereto to provide a reconstituted tobacco material. See, U.S. Pat. Nos. 4,962,774 to Thomasson, et al. and U.S. Pat. No. 4,987,906 to Young, et al. and U.S. patent application Ser. No. 710,273, filed Jun. 4, 1991, which are incorporated herein by reference.

The tobacco extract and extraction solvent can be contacted with the extracted tobacco material, so as to provide a re-equilibrated or re-established processed tobacco material, often using a counter current extraction apparatus of the type set forth in U.S. Pat. No. 4,363,264 to Lang, et al., and described previously herein with reference to FIG. 1. Although, the extract and solvent can be contacted with the extracted tobacco material co-currently, it is preferable to contact those materials in a counter current manner. As such, components of the tobacco extract intimately contact the tobacco material (e.g., tobacco pulp) insoluble in the extraction solvent. If desired, the tobacco extract can be provided from one type of tobacco, and the extracted tobacco material can be provided from another type of tobacco. Normally, extracted components include those substances which are soluble or otherwise dissolve in the solvent, or are highly dispersible within the solvent. During such contact, there exists a dynamic state whereby tobacco components soluble or dispersible in the solvent become dispersed throughout the mixture to some degree.

The extract and solvent preferably are contacted with the extracted tobacco material in a counter rotating extraction apparatus normally using screw speeds, rotation times and pause times similar to those described previously with regards to extraction conditions. conditions of temperature can be less than, greater than or about equal to, ambient temperature. Typically, such contact is performed within a temperature range of about 2° C. to about 90° C., often about 10° C. to about 80° C., and frequently about 50° C. to about 70° C. Contact conditions are maintained until adequate contact of the extract with the insoluble tobacco material occurs (e.g., there is provided fairly uniform contact of the extract components with the insoluble tobacco material). A typical average residence time for the insoluble tobacco material ranges from about 20 to about 60 minutes. As such, the components of the extract are well distributed, infused or re-established within the insoluble tobacco material. The material so provided is removed from the extraction apparatus and is collected.

The extracted tobacco material which has been contacted with the processed tobacco extract and extraction solvent is separated from a portion of the tobacco extract and solvent (e.g., the mixture is deliquored). As such, there is provided a mixture of extraction solvent, extract and tobacco material insoluble in the solvent (e.g., a moist mixture of extract and water insoluble tobacco material, when the solvent is water). The tobacco material insoluble in the solvent can vary, depending upon the solvent and extraction conditions. However, for a solvent having an aqueous character, a typical insoluble tobacco material includes components of the biopolymer matrix of the tobacco material (e.g., cellulosics) and other tobacco components which are not dissolved in the solvent or are not otherwise extracted by the solvent. For purposes of the present invention, insoluble materials are tobacco components not extracted by the particular solvent which is employed under the selected extraction conditions.

Typical deliquoring processes or steps involve using converging belts, centrifuges, screw presses, rotating disk presses, or other pressing or squeezing means. Typically, the deliquored mixture of tobacco extractables and insoluble extracted material has a solvent content of about 55 to about 90 weight percent, preferably about 60 to about 85 weight percent; particularly when the weight of the solvent within the mixture prior to the deliquoring step is more than about 10 times that weight of the extracted tobacco material within that mixture. The deliquored mixture of tobacco extractables and insoluble extracted tobacco material can be dried using hot air columns, apron dryers, microwave dryers, or the like. Typically, deliquored tobacco material is dried to a moisture level of about 10 to about 15 weight percent, preferably about 12 to about 13 weight percent.

The processed tobacco material, which has had a desired amount of solvent removed therefrom, can be further processed prior to the time that it is used for the manufacture of cigarettes or other smoking articles. In particular, processed tobacco material in strip form and having a fairly high moisture content can be shredded into cut filler form using known techniques, and then dried for further use. The processed tobacco material can be volume expanded using known techniques, particularly when the processed tobacco material is in cut filler form. The processed tobacco material can be subjected to reconstitution processing steps (e.g., using known papermaking, cast sheet or extrusion techniques), particularly when the processed tobacco material is in the form of dust, fines, stem and/or scrap. For example, an aqueous tobacco extract which is provided using the process of the present invention can be applied to an insoluble tobacco material which has been provided using the process of the present invention, using a papermaking-type reconstitution process. The processed tobacco material can be cased, top dressed, or otherwise treated in order to alter the flavor or smoking characteristics thereof. The processed tobacco material then can be used as the smokable filler material for the manufacture of cigarettes, or blended with other smokable materials for the manufacture of cigarettes.

The process of the present invention can be employed so as to provide a processed tobacco material in a non-destructive manner. That is, a tobacco material (e.g., cut filler, stems or strip) can be subjected to extraction conditions, and an extracted tobacco material can be re-equilibrated, according to the process of the present invention without experiencing any significant physical degradation. Typically, less than 8 percent, and usually less than about 5 percent, of the dry weight of the insoluble tobacco pulp which is processed according to the present invention is lost as fines during processing. For example, a blend of tobacco cut filler having shredded at 25 cuts per inch can be extracted with tap water according to the process of the present invention, and the resulting extracted tobacco material exhibits a retention approximately equal to that of the starting tobacco material when tested using an M-46 Clark Pulp Classifier from Thwig-Albert Instrument Co.

Tobacco extract and extraction solvent which are contacted with the extracted tobacco material (i.e., the extract and solvent separated from the tobacco material, including the portion separated during the deliquoring step) are collected. Although not necessary, the extract so collected can be processed to remove certain substance(s) therefrom, have certain additives applied thereto, and/or provided at a desired dissolved solids level with extraction solvent. If desired, further solvent and further processed extract can be incorporated into the extract and solvent which is collected, in order to provide a tobacco extract and solvent mixture having a desired, predetermined tobacco extract level. As such, a processed extract is regenerated for use in altering the chemical composition of a further lot of extracted tobacco material.

The following examples are provided in order to further illustrate various embodiments of the invention, but should not be construed as limiting the scope thereof. Unless otherwise noted, all parts and percentages are by weight.

EXAMPLE 1

A process for producing a processed tobacco material is performed as follows:

A blended mixture of about 54 parts flue-cured tobacco stems and about 46 parts tobacco scrap is provided. The tobacco stems are employed in the form received from the tobacco stemmery. The tobacco scrap is composed of flue-cured, Burley and Oriental types of tobacco. The tobacco scrap has a size which passes through a 14 mesh screen with 0.0534 inch opening and is retained on a 4 mesh screen with 0.0185 inch opening.

A continuous counter current extractor available as CCE Model No. 1000 from Counter Current Technology Pty. Ltd. is provided. The extractor is described in U.S. Pat. No. 4,363,264 to Lang, et al. The trough of the extractor is partially filled with liquid tap water at about 135° F. The trough is positioned at 4° relative to horizontal so that tobacco material introduced at one end of the trough travels upwards during continuous extraction and water introduced at the other end of the trough travels downwards during continuous extraction. The screw, which has a pitch of 715 mm, is positioned in the trough. The screw L/D is the standard 8:1 for that extractor as purchased, and includes a plurality of slits or openings about 6 mm wide on each flight of the screw. A screen which is positioned upstream from the tobacco material input region has a plurality of 2.5 mm linear openings between No. 69 profile wire.

The screw is operated alternately for 20 seconds forward at a speed of 1.5 rpm and for 14.1 seconds reverse at a speed of 1.5 rpm. The screw is not rotated (i.e., experiences a pause time) for 2.5 seconds each time the screw changes direction of operation. The tobacco material is introduced continuously into the extractor at a rate of about 525 pounds/hour, and tap water at about 135° F. is fed continuously through the extractor at a rate of about 3200 pounds/hour. Water and tobacco extract exiting the extractor is not fed back into the extractor along with the tobacco material to be extracted.

The residence time of the tobacco material in the extractor averages about 45 minutes. Wet extracted tobacco material is removed from one end of the extractor, and a liquid extract having a tobacco extract content of about 14 percent is collected at the other end of the extractor. The tobacco material entering the extractor has about 47 percent hot water solubles and the extracted mixture has about 14 percent hot water solubles, representing a removal of about 81 percent of the hot water solubles from the stem and scrap, on a dry weight basis.

EXAMPLE 2

Aged flue-cured tobacco in strip form is extracted using water to provide an aqueous tobacco extract, as follows:

A continuous counter current extractor available as CCE Model No. 500 from Counter Current Technology Pty. Ltd. is provided. The extractor is described in U.S. Pat. No. 4,363,264 to Lang, et al. The trough of the extractor is filled with tap water at about 130° F. The trough is positioned at 7.5° relative to horizontal so that tobacco material introduced at one end of the trough travels upwards during continuous extraction and water introduced at the other end of the trough travels downwards during continuous extraction. The screw of the extractor is standard for that extractor as purchased, and the screen which is positioned upstream from the tobacco material input region has a plurality of 2.5 mm linear openings between No. 69 profile wire.

The screw is operated alternately for 9 seconds forward at a speed of 4 rpm and for 16.1 seconds reverse at a speed of 2 rpm. Tobacco strip is introduced continuously into the extractor at a rate of about 70 pounds/hour, and tap water at about 130° F. is fed continuously through the extractor at a rate of about 700 pounds/hour. Water and tobacco extract exiting the extractor is heated to about 130° F., and is fed back into the extractor along with tobacco material to be extracted, at a rate of about 1 to about 2 gallons/min.

The residence time of the tobacco strip in the extractor averages about 80 minutes. Wet extracted tobacco material is removed from one end of the extractor, and a liquid extract having a tobacco extract content of about 6.5 percent is collected at the other end of the extractor. The tobacco material entering the extractor has about 50 percent hot water solubles and the extracted mixture has about 6.5 percent hot water solubles, representing a removal of more than about 93 percent of the hot water solubles from the strip, on a dry weight basis.

EXAMPLE 3

Aged Burley tobacco in stem form is extracted using water to provide an aqueous tobacco extract having a relatively high content of tobacco extract, as follows:

Burley tobacco stem, in pieces having lengths of about 0.5 inch to about 2 inches, and maximum widths of up to about 0.25 inch, is provided.

A continuous counter current extractor available as CCE Model No. 1000 from Counter Current Technology Pty. Ltd. is provided. The trough of the extractor is filled with tap water at about 130° F. The trough is positioned at 7° relative to horizontal so that tobacco material introduced at one end of the trough travels upwards during continuous extraction and water introduced at the other end of the trough travels downwards during continuous extraction. The screw of the extractor is standard for that extractor purchased, and a screen is positioned upstream from the tobacco material input region.

The screw is operated alternately for 20 seconds forward at a speed of 1.88 rpm and for 16.5 seconds reverse at a speed of 1.88 rpm. The screw is not rotated (i.e., experiences a pause time for 1 second each time the screw changes direction of operation. Tobacco stem material is introduced continuously into the extractor at a rate of about 600 pounds/hour, and tap water at about 130° F. is fed continuously through the extractor at a rate of about 3400 pounds/hour. Water and tobacco extract exiting the extractor is fed back into the extractor along with tobacco material to be extracted, at a rate of about 10 gallons/min.

The residence time of the tobacco stem material in the extractor averages about 60 minutes. Wet extracted tobacco stem material is removed from one end of the extractor, a liquid extract having a tobacco extract content of about 31 percent is collected at the other end of the extractor. The tobacco material entering the extractor has about 41 percent hot water solubles and the extracted mixture has about 9 percent hot water solubles, representing a removal of about 86 percent of the hot water solubles from the stems, on a dry weight basis.

EXAMPLE 4

An aged blend of tobaccos in cut filler form is extracted using water to provide an aqueous tobacco extract, as follows:

A blend of 49.25 parts flue-cured, 28.5 parts Burley and 22.25 parts Oriental tobaccos, in cut filler form shredded at about 25 cuts per inch in provided.

A continuous counter current extractor available as CCE Model No. 1000 from Counter Current Technology Pty. Ltd. is provided. The trough of the extractor is filled with tap water at about 130° F. The trough is positioned at 7° relative to horizontal so that tobacco material introduced at one end of the trough travels upwards during continuous extraction and water introduced at the other end of the trough travels downwards during continuous extraction. The screw of the extractor is standard for that extractor purchased, and a screen is positioned upstream from the tobacco material input region.

The screw is operated alternately for 20 seconds forward at a speed of 1.88 rpm and for 17 seconds reverse at a speed of 1.88 rpm. The screw is not rotated (i.e., experiences a pause time for 1 second each time the screw changes direction of operation. Tobacco stem material is introduced continuously into the extractor at a rate of about 550 pounds/hour, and tap water at about 130° F. is fed continuously through the extractor at a rate of 2600 pounds/hour. Water and tobacco extract exiting the extractor is fed back into the extractor along with tobacco material to be extracted, at a rate of about 10 gallons/min.

The residence time of the tobacco stem material in the extractor averages about 70 minutes. Wet extracted tobacco material is removed from one end of the extractor, a liquid extract having a tobacco extract content of about 19.4 percent is collected at the other end of the extractor. The tobacco material entering the extractor has about 49 percent hot water solubles and the extracted mixture has about 8.75 percent hot water solubles, representing a removal of about 90 percent of the hot water solubles from the cut filler, on a dry weight basis.

EXAMPLE 5

A process for producing a processed tobacco material is performed as follows:

A. Preparation of a Spray Dried Extract

Aged flue-cured tobacco, in cut filler form shredded at 32 cuts per inch, and having a dry weight water soluble portion of about 50 percent, is extracted continuously essentially as described in Example 4.

The aqueous extract is concentrated in a thin film evaporator to a concentration of about 30 percent dissolved solids. Thin film evaporation conditions are such that water is evaporated from the extract while loss of tobacco volatiles is minimized. The concentrated aqueous extract then is spray dried by continuously pumping the aqueous solution to an Anhydro spray dryer. The dried powder is collected at the outlet of the dryer. The inlet temperature of the spray dryer is about 215° C., and the outlet temperature is about 80° C.

The spray dried tobacco extract is a brown, powdery material, and has a moisture content of about 5 percent. Spray drying allows the tobacco extract to be stored for further use.

B. Extraction of Tobacco Material

An aged blend of tobaccos in cut filler form, and described in Example 4, is provided.

A continuous counter current extractor available as CCE Model No. 500 from Counter Current Technology Pty. Ltd. is provided. The trough of the extractor is filled with tap water at about 150° F. The trough is positioned at 7.5° relative to horizontal so that tobacco material introduced at one end of the trough travels upwards during continuous extraction and water introduced at the other end of the trough travels downwards during continuous extraction. The screw of the extractor is standard for that extractor purchased, and a screen is positioned upstream from the tobacco material input region.

The screw is operated alternately for 9 seconds forward at a speed of 4 rpm and for 1.65 seconds reverse at a speed of 2 rpm. The screw experiences no pause time each time the screw changes direction of operation. Tobacco material is introduced continuously into the extractor at a rate of 95 pounds/hour, and tap water at about 150° F. is fed continuously through the extractor at a rate of 800 pounds/hour. Water and tobacco extract exiting the extractor is fed back into the extractor along with tobacco material to be extracted, at a rate of 2 gallons/min.

The residence time of the tobacco material in the extractor averages about 60 minutes. Wet extracted tobacco material is removed from the extractor. About 95 percent of the hot water solubles is removed therefrom. The wet extracted tobacco material is pressed using a Model 600 Fibercone Press from The Black Clawson Co. to a moisture level of about 75 percent.

C. Re-equilibration

The trough of the extractor is partially filled with about 20 gallons with 90 parts water and 10 parts of the spray dried extract dissolved therein. The resulting aqueous tobacco extract is provided at about 120° F. The liquid extract reaches the top of the overflow pipe at the extreme upstream end of the extractor.

A continuous counter current extractor available as CCE Model No. 500 from Counter Current Technology Pty. Ltd. is provided. The trough is positioned at 7.5° relative to horizontal so that extracted tobacco material continuously introduced at one end of the trough travels upwards during continuous re-equilibration and aqueous extract continuously introduced at the other end of the trough travels downwards during continuous re-equilibration. The screw of the extractor is standard for that extractor purchased, and a screen is positioned upstream from the tobacco material input region.

The screw is operated alternately for 12 seconds forward at a speed of 2.14 rpm and for 8 seconds reverse at a speed of 2 rpm. The screw does not experience a pause time each time the screw changes direction of operation. Extracted material is introduced continuously into the extractor at a rate of about 300 pounds/hour (i.e., about 70 pounds/hour on a dry weight basis). After about 10 minutes of initial introduction of extracted tobacco material into the extractor, about 20 gallons of a liquid extract at about 120° F. (e.g., about 85 parts water and about 15 parts of the spray dried extract dissolved therein) is introduced into the extractor just downstream of the extracted tobacco material over a 10 minute period. Then, liquid aqueous extract (e.g., about 70 parts water and about 30 parts of the spray dried extract) at about 120° F. is fed continuously through the extractor at a rate of 350 pounds/hour. The aqueous extract exiting the liquid discharge port includes a consistent concentration of about 15 percent dissolved tobacco solids (i.e., extract) and about 85 percent water.

The residence time of the extracted tobacco material in the extractor averages about 30 minutes. As such, the extracted tobacco material is subjected to infusion conditions.

Wet tobacco material is removed from the extractor through the outlet spout at one end of the extractor and collected. Aqueous extract also is removed from the extractor through the liquid discharge line at the other end of the extractor and collected. The mixture exiting the extractor has about 10 pounds of aqueous tobacco extract in contact with each pound of dry extracted tobacco material. The mixture of extracted tobacco material, extract and solvent is pressed using a Model 600 Fibercone Press from The Black Clawson Co., to provide a mixture of about 5 pounds aqueous tobacco extract and about 1 pound of extracted tobacco material. The moisture content of the pressed mixture is about 64 percent. The material is dried using a rotary dryer and an apron dryer in series. The processed tobacco material which then is collected has a moisture content of about 13 percent. The resulting re-equilibrated tobacco material has a hot water solubles content of about 49 percent, which is about equal to that of the tobacco material prior to processing.

What is claimed is:

1. A process for extracting a tobacco material, the process comprising the steps of:

(a) providing tobacco material;

(b) providing a liquid solvent;

(c) providing an apparatus for extracting the tobacco material using the solvent, the apparatus having a screw conveyor and being positioned at an incline relative to horizontal;

(d) continuously introducing the tobacco material and solvent into the apparatus in a counter current manner such that the tobacco material moves overall upwards through the apparatus and the solvent moves overall downwards through the apparatus;

(e) subjecting the tobacco material to extraction conditions while operating the screw conveyor in a counter rotating manner;

(f) removing extracted tobacco material from the apparatus and collecting such extracted tobacco material; and (g) removing solvent and tobacco extract from the apparatus and collecting such solvent and extract.

2. The process of claim 1 whereby the tobacco material has the form of tobacco cut filler.

3. The process of claim 1 whereby the solvent is water.

4. The process of claim 1 whereby the apparatus is positioned at an incline of about 4° to about 8° relative to horizontal.

5. A process for re-equilibrating an extracted tobacco material with tobacco extract, the process comprising the steps of:

(a) providing extracted tobacco material;

(b) providing a tobacco extract within a liquid solvent therefor;

(c) providing an apparatus for contacting the extracted tobacco material with solvent and tobacco extract, the apparatus having a screw conveyor and being positioned at an incline relative to horizontal;

(d) continuously introducing the extracted tobacco material and tobacco extract within solvent into the apparatus in a counter current manner such that the extracted tobacco material moves overall upwards through the apparatus, and the extract and solvent moves overall downwards through the apparatus;

(e) subjecting the extracted tobacco material to infusion conditions while operating the screw conveyor in a counter rotating manner;

(f) removing extracted tobacco material, extract and solvent from the apparatus and collecting such; and (g) removing solvent and tobacco extract from the apparatus and collecting such.

6. The process of claim 5 whereby the extracted tobacco material has the form of extracted tobacco cut filler.

7. The process of claim 5 whereby the solvent is water.

8. The process of claim 5 whereby the apparatus is positioned at an incline of about 4° to about 8° relative to horizontal.

* * * * *